US010837645B2

(12) United States Patent
Merlau et al.

(10) Patent No.: US 10,837,645 B2
(45) Date of Patent: Nov. 17, 2020

(54) TURBOMACHINE COUPLING ASSEMBLY

(71) Applicant: General Electric Company, Schenectady, NY (US)

(72) Inventors: Thomas Michael Merlau, Greenville, SC (US); Joseph Daniel Becker, Travelers Rest, SC (US); Stuart Craig Hanson, Anderson, SC (US)

(73) Assignee: General Electric Company, Schenectady, NY (US)

( * ) Notice: Subject to any disclaimer, the term of this patent is extended or adjusted under 35 U.S.C. 154(b) by 251 days.

(21) Appl. No.: 15/493,356

(22) Filed: Apr. 21, 2017

(65) Prior Publication Data

US 2018/0306446 A1 Oct. 25, 2018

(51) Int. Cl.
*F23R 3/60* (2006.01)
*B25B 5/00* (2006.01)
(Continued)

(52) U.S. Cl.
CPC ..... *F23R 3/60* (2013.01); *B25B 5/003* (2013.01); *B25B 5/101* (2013.01); *B25B 5/147* (2013.01);
(Continued)

(58) Field of Classification Search
CPC .. F23R 3/60; F23R 3/002; F23R 2900/00017; F23R 2900/00019; B25B 5/003; B25B 5/101; B25B 5/147; B25B 5/166; B25B 1/00; B25B 3/00; B25B 5/00; B66F 3/08; F01D 25/285; F05D 2230/64; F05D 2230/68; F05D 2230/72; F05D 2240/14;
(Continued)

(56) References Cited

U.S. PATENT DOCUMENTS 2,706,495 A 4/1955 Risley
4,039,115 A * 8/1977 Randolph ..... B23K 37/0538 228/44.5
(Continued)

FOREIGN PATENT DOCUMENTS

DE 43 40 530 A1 6/1995
EP 2 489 938 A2 8/2012
(Continued)

OTHER PUBLICATIONS

Extended European Search Report and Opinion issued in connection with corresponding EP Application No. 18167687.5 dated Aug. 31, 2018.

*Primary Examiner* — Ehud Gartenberg
*Assistant Examiner* — Henry Ng
(74) *Attorney, Agent, or Firm* — Dority & Manning, P.A.

(57) ABSTRACT

The present disclosure is directed to a coupling assembly for a turbomachine. The coupling assembly includes a liner and a sleeve at least partially positioned circumferentially around the liner. A frame is positioned between the liner and the sleeve. The frame includes a first side wall, a second side wall, and a base wall extending from the first side wall to the second side wall. A block is positioned between the liner and the sleeve and is movable relative to the frame to permit the block to move toward and away from the base wall. Moving the block away from the base wall causes the block to exert an inward force on the liner and the base wall to exert an outward force on the sleeve.

19 Claims, 7 Drawing Sheets

(51) Int. Cl.

| | |
|---|---|
| ***F01D 9/02*** | (2006.01) |
| ***B25B 5/10*** | (2006.01) |
| ***B25B 5/14*** | (2006.01) |
| ***B66F 3/08*** | (2006.01) |
| ***B25B 5/16*** | (2006.01) |
| ***F01D 25/28*** | (2006.01) |
| ***F23R 3/00*** | (2006.01) |

(52) U.S. Cl.
CPC ..... *B25B 5/166* (2013.01); *B66F 3/08* (2013.01); *F01D 9/023* (2013.01); *F01D 25/285* (2013.01); *F23R 3/002* (2013.01); *F05D 2230/64* (2013.01); *F05D 2230/68* (2013.01); *F05D 2230/72* (2013.01); *F05D 2240/14* (2013.01); *F05D 2260/02* (2013.01); *F05D 2260/30* (2013.01); *F23R 2900/00017* (2013.01); *F23R 2900/00019* (2013.01)

(58) Field of Classification Search
CPC ..... F05D 2260/02; F05D 2260/30; Y10T 403/7062; Y10T 403/7067; F16B 2/03; F16B 2/04; F16B 7/04; F16B 7/0406; F16B 7/0413; F16B 7/18; F16B 7/182
USPC ..... 60/752; 431/202; 285/23, 123.1, 132.2, 285/123.4, 123.3, 123.13, 124.2; 269/43, 269/6, 3
See application file for complete search history.

(56) References Cited

U.S. PATENT DOCUMENTS

| | | | | |
|---|---|---|---|---|
| 4,202,539 | A * | 5/1980 | Polastri | B23Q 1/527 269/287 |
| 4,337,932 | A * | 7/1982 | Dennis | B23B 31/4046 269/23 |
| 4,491,307 | A * | 1/1985 | Ellefson | B23K 37/0452 269/246 |
| 5,392,322 | A | 2/1995 | Whitling et al. | |
| 5,513,838 | A * | 5/1996 | Van Rossum | B25B 5/003 269/203 |
| 5,600,690 | A | 2/1997 | Weems et al. | |
| 6,158,475 | A | 12/2000 | Clemmer | |
| 6,371,468 | B1 * | 4/2002 | Lessard | B25B 5/003 269/238 |
| 6,371,685 | B1 | 4/2002 | Weems et al. | |
| 6,571,832 | B1 | 6/2003 | Elliot | |
| 6,708,966 | B1 * | 3/2004 | Troudt | B25B 5/067 269/249 |
| 7,225,837 | B1 * | 6/2007 | Kane | F16L 7/00 138/108 |
| 8,104,290 | B2 | 1/2012 | Ellis et al. | |
| 8,448,444 | B2 * | 5/2013 | Cihlar | F01D 9/023 60/772 |
| 2001/0045695 | A1 * | 11/2001 | Andronica | B25B 1/2452 269/268 |
| 2011/0247193 | A1 * | 10/2011 | Herbold | F23R 3/002 29/464 |
| 2011/0314829 | A1 | 12/2011 | Kuppusamy | |
| 2012/0036857 | A1 * | 2/2012 | Bassani | F23R 3/60 60/752 |
| 2012/0096700 | A1 * | 4/2012 | Patterson | F16L 25/06 29/428 |
| 2012/0186269 | A1 | 7/2012 | Cihlar et al. | |
| 2014/0230246 | A1 | 8/2014 | McMahon et al. | |
| 2015/0071704 | A1 | 3/2015 | Senofonte et al. | |
| 2018/0038520 | A1 | 2/2018 | Pionetti | |

FOREIGN PATENT DOCUMENTS

| | | | |
|---|---|---|---|
| EP | 3 293 370 | A1 | 3/2018 |
| EP | 18167687.5-1017 | | 3/2020 |
| FR | 3 032 511 | A1 | 8/2016 |
| WO | 2014/126641 | A1 | 8/2014 |

* cited by examiner

TURBOMACHINE COUPLING ASSEMBLY

FIELD

The present disclosure generally relates to turbomachines. More particularly, the present disclosure relates to coupling assemblies for turbomachines.

BACKGROUND

A gas turbine engine generally includes a compressor, one or more combustors, and a turbine. The compressor progressively increases the pressure of air entering the gas turbine engine and supplies this compressed air to the one or more combustors. The compressed air and a fuel (e.g., natural gas) mix within the combustors and burn in a combustion chamber to generate high pressure and high temperature combustion gases. The combustion gases flow from the combustors into the turbine where they expand to produce work. For example, expansion of the combustion gases in the turbine may rotate a rotor shaft connected, e.g., to a generator to produce electricity. The combustion gases then exit the gas turbine via an exhaust section.

Each combustor generally includes an outer casing, a combustion liner, and an outer sleeve. The outer casing surrounds the combustor and contains the compressed air received from the compressor therein. The combustion liner is positioned within the outer casing and defines at least a portion of the combustion chamber. The outer sleeve circumferentially surrounds at least a portion of the combustion liner. As such, the outer sleeve and the combustion liner collectively define a cooling flow passage therebetween through which the compressed air may flow before entering the combustion chamber. One or more fuel nozzles supply the fuel to each combustor for mixing with the compressed air therein. This fuel-air mixture flows into the combustion chamber where a spark plug or other ignition device may initiate combustion.

The combustion liner and the outer sleeve may be permitted to move relative to one another during operation of the gas turbine engine to accommodate varying rates of thermal expansion. In this respect, the combustion liner and the outer sleeve may also move relative to each other during removal from the gas turbine engine for maintenance. This may result in expensive and time-consuming repairs to the various coatings on the combustion liner and the outer sleeve.

BRIEF DESCRIPTION

Aspects and advantages of the technology will be set forth in part in the following description, or may be obvious from the description, or may be learned through practice of the technology.

In one aspect, the present disclosure is directed to a coupling assembly for a turbomachine. The coupling assembly includes a liner and a sleeve at least partially positioned circumferentially around the liner. A frame is positioned between the liner and the sleeve. The frame includes a first side wall, a second side wall, and a base wall extending from the first side wall to the second side wall. A block is positioned between the liner and the sleeve and is movable relative to the frame to permit the block to move toward and away from the base wall. Moving the block away from the base wall causes the block to exert an inward force on the liner and the base wall to exert an outward force on the sleeve.

In another aspect, the present disclosure is directed to a turbomachine having a combustion liner and an outer sleeve at least partially positioned circumferentially around the combustion liner. A plurality of coupling tools couples the combustion liner and the outer sleeve. Each coupling tool includes a frame positioned between the combustion liner and the outer sleeve. The frame includes a first side wall, a second side wall, and a base wall extending between the first side wall and the second side wall. A block is positioned between the combustion liner and the outer sleeve and is movable relative to the frame to permit the block to move toward and away from the base wall. Moving the block away from the base wall causes the block to exert an inward force on the combustion liner and the base wall to exert an outward force on the outer sleeve.

In a further aspect, the present disclosure is directed to a coupling assembly for a turbomachine. The coupling assembly includes a liner defining a liner aperture and a sleeve at least partially positioned circumferentially around the liner. The sleeve defines a sleeve aperture. A body positioned is between the liner and the sleeve. A pin extends through the liner aperture to couple the liner and the body. A clamp member is positioned outward of the sleeve. A threaded member extends through the sleeve aperture and coupled to the body and the clamp member. The threaded member permits the clamp member to move toward and away from the body. Moving the clamp member toward the body causes the body to exert an outward force on the sleeve and the clamp member to exert an inward force on the sleeve to couple the sleeve and the body.

These and other features, aspects and advantages of the present technology will become better understood with reference to the following description and appended claims. The accompanying drawings, which are incorporated in and constitute a part of this specification, illustrate embodiments of the technology and, together with the description, serve to explain the principles of the technology.

BRIEF DESCRIPTION OF THE DRAWINGS

A full and enabling disclosure of the present technology, including the best mode thereof, directed to one of ordinary skill in the art, is set forth in the specification, which makes reference to the appended figures, in which.

Figure 1:
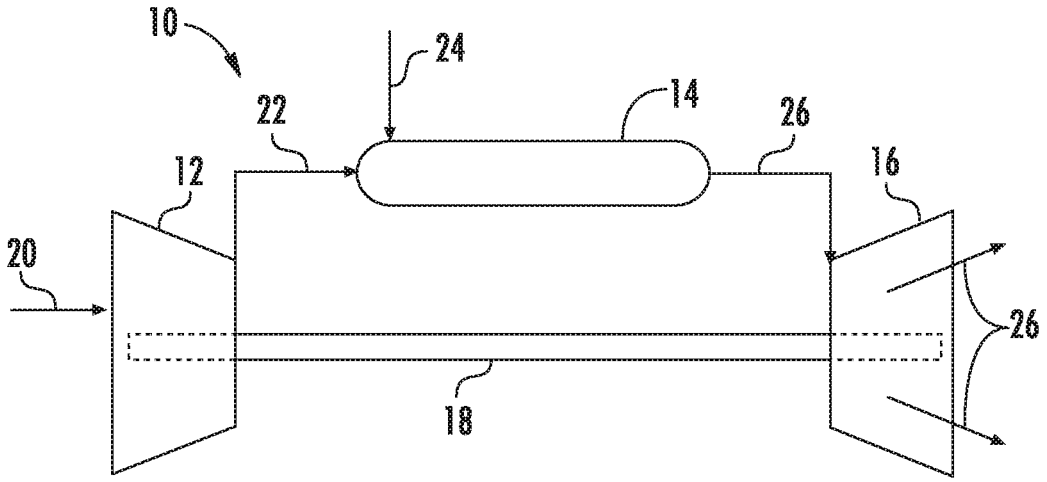
FIG. 1 is a schematic view of an exemplary gas turbine engine in accordance with embodiments of the present disclosure.

Repeat use of reference characters in the present specification and drawings is intended to represent the same or analogous features or elements of the present technology.

DETAILED DESCRIPTION

Reference will now be made in detail to present embodiments of the technology, one or more examples of which are illustrated in the accompanying drawings. The detailed description uses numerical and letter designations to refer to features in the drawings. Like or similar designations in the drawings and description have been used to refer to like or similar parts of the technology. As used herein, the terms "first", "second", and "third" may be used interchangeably to distinguish one component from another and are not intended to signify location or importance of the individual components. The terms "upstream" and "downstream" refer to the relative direction with respect to fluid flow in a fluid pathway. For example, "upstream" refers to the direction from which the fluid flows, and "downstream" refers to the direction to which the fluid flows.

Each example is provided by way of explanation of the technology, not limitation of the technology. In fact, it will be apparent to those skilled in the art that modifications and variations can be made in the present technology without departing from the scope or spirit thereof. For instance, features illustrated or described as part of one embodiment may be used on another embodiment to yield a still further embodiment. Thus, it is intended that the present technology covers such modifications and variations as come within the scope of the appended claims and their equivalents.

Although an industrial or land-based gas turbine is shown and described herein, the present technology as shown and described herein is not limited to a land-based and/or industrial gas turbine unless otherwise specified in the claims. For example, the technology as described herein may be used in any type of turbomachine including, but not limited to, aviation gas turbines (e.g., turbofans, etc.), steam turbines, and marine gas turbines.

Referring now to the drawings, FIG. 1 illustrates a schematic diagram of an exemplary gas turbine engine 10. As shown, the gas turbine engine 10 may generally include a compressor 12, at least one combustor 14 disposed downstream of the compressor 12, and a turbine 16 disposed downstream of the combustor 14. The gas turbine engine 10 may also include one or more shafts 18 that couple the compressor 12 to the turbine 16.

During operation, air 20 flows into the compressor 12, where the air 20 is progressively compressed to provide pressurized air 22 to the combustor 14. At least a portion of the pressurized air 22 mixes with a fuel 24 and burns within the combustor 14 to produce combustion gases 26. The combustion gases 26 flow from the combustor 14 into the turbine 16, where rotor blades (not shown) extract kinetic and/or thermal energy from the combustion gases 26. This energy extraction causes the shaft 18 to rotate. The mechanical rotational energy of the shaft 18 may then be used to, e.g., power the compressor 12 and/or to generate electricity. The combustion gases 26 may then be exhausted from the gas turbine engine 10.

Figure 2:
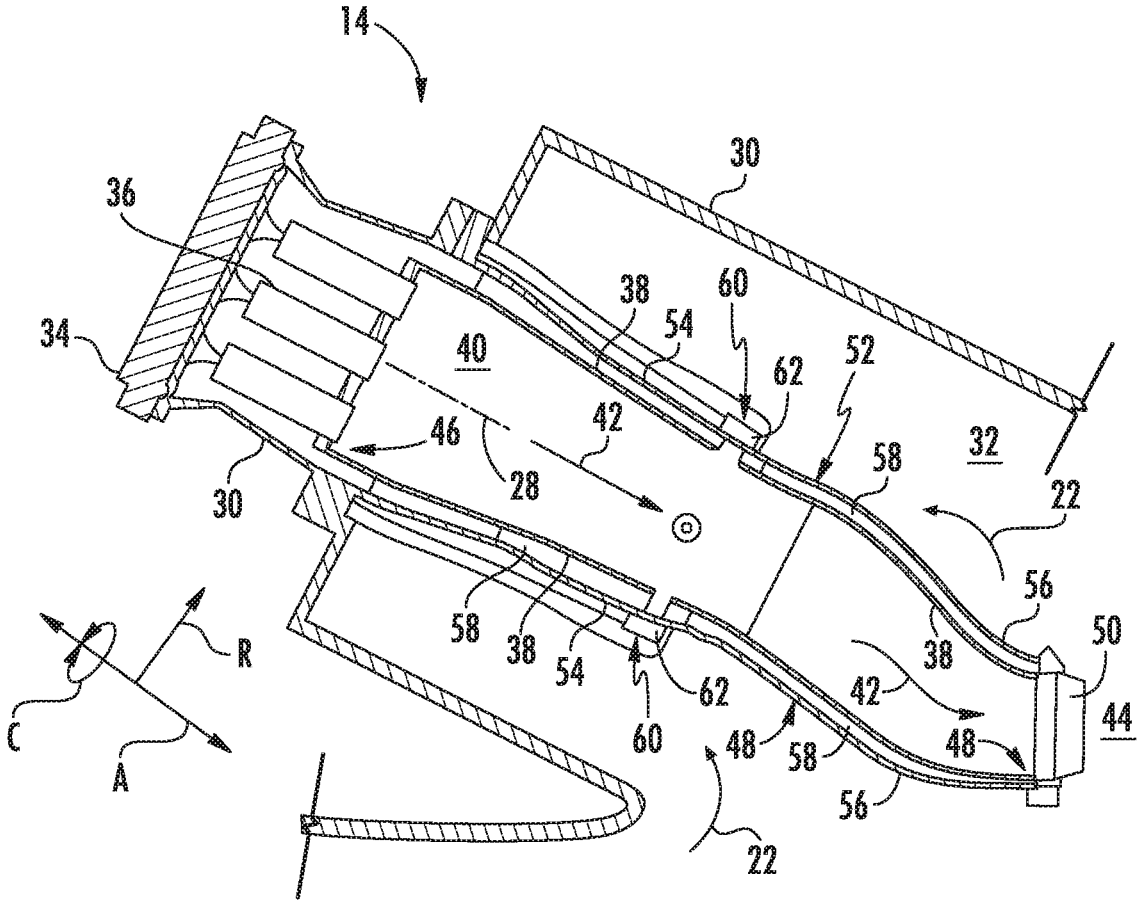
FIG. 2 is a cross-sectional side view of an exemplary combustor in accordance with embodiments of the present disclosure.

FIG. 2 illustrates an exemplary embodiment of one of the combustors 14. As depicted, the combustor 14 defines an axial centerline 28 extending therethrough. In this respect, the combustor 14 defines an axial direction A, a radial direction R, and a circumferential direction C. In general, the axial direction A extends parallel to the axial centerline 28, the radial direction R extends orthogonally outward from the axial centerline 28, and the circumferential direction C extends concentrically around the axial centerline 28.

As shown in FIG. 2, the combustor 14 may be at least partially surrounded by an outer casing 30, such as a compressor discharge casing. The outer casing 30 may at least partially define a high pressure plenum 32, which at least partially surrounds various components of the combustor 14. The high pressure plenum 32 may be in fluid communication with the compressor 12 (FIG. 1) so as to receive a portion of the compressed air 22 therefrom. An end cover 34 may be coupled to the outer casing 30. One or more fuel nozzles 36 may extend axially downstream from the end cover 34.

A combustion liner or duct 38 may at least partially define a combustion chamber or zone 40 downstream from the one or more fuel nozzles 36. The combustion liner 38 may also at least partially define a hot gas path 42 through the combustor 14 for directing the combustion gases 26 (FIG. 1) towards an inlet 44 to the turbine 16. In some embodiments, the combustion liner 38 may be formed from a singular body or unibody. The combustion liner 38 may include a forward end 46, which may be cylindrical or round. The combustion liner 38 may then transition to a non-circular or substantially rectangular cross-sectional shape proximate to an aft end 48 thereof.

The aft end 48 of the combustion liner 38 may terminate at an aft frame 50. The aft frame 50 may be used to mount the combustion liner 38 to the outer casing 30 or to other support hardware, thereby fixing or axially restraining the aft end 48 of the combustion liner 38. As such, the forward end 46 of the combustion 38 may expand and contract axially towards the one or more fuel nozzles 36 as the combustor 14 transitions through various thermal conditions.

As shown, the combustion liner 38 is at last partially circumferentially surrounded by an outer sleeve 52. The outer sleeve 52 may be formed as a single component or formed by multiple sleeve segments, such as by a flow sleeve 54 and an impingement sleeve 56. The impingement sleeve 56 may slidably engage the flow sleeve 54 to permit relative axial movement therebetween. The outer sleeve 52 is radially spaced from the combustion liner 38 so as to define a cooling flow passage 58 therebetween. The outer sleeve 52 may define a plurality of apertures (not shown) that fluidly couple the cooling flow passage 58 and the high pressure plenum 32. In particular embodiments, the outer sleeve 52 may be generally or substantially unrestrained in the axial direction A with respect to the axial centerline 28 of the combustor 14. As such, the outer sleeve 52 may expand and contract axially toward the one or more fuel nozzles 36 and/or toward the aft frame 50 as the combustor 14 transitions through various thermal conditions.

In certain embodiments, the combustor 14 may include at least one auxiliary component 60 axially offset from and disposed downstream from the fuel nozzle(s) 36. The auxiliary component(s) 60 may include any component having a portion thereof that extends radially through the outer sleeve 52, the cooling flow passage 58, and at least partially through the combustion liner 38. For example, the auxiliary component 60 may be a spark igniter, a sensor, a probe, or other combustion hardware device. In the embodiment shown in FIG. 2, the auxiliary component 60 is a fuel injector 62 axially offset from and disposed downstream from the fuel nozzle(s) 36. As shown, the combustor 14 may include a plurality of fuel injectors 62. In particular, the fuel injector 62 extends radially through the outer sleeve 52, the cooling flow passage 58, and at least partially through the combustion liner 38. In this respect, the fuel injector 62 provides a secondary fuel and air mixture to the hot gas path 42 defined within the combustion liner 38 downstream from the fuel nozzle(s) 36 and/or the combustion zone 40.

Figure 3:
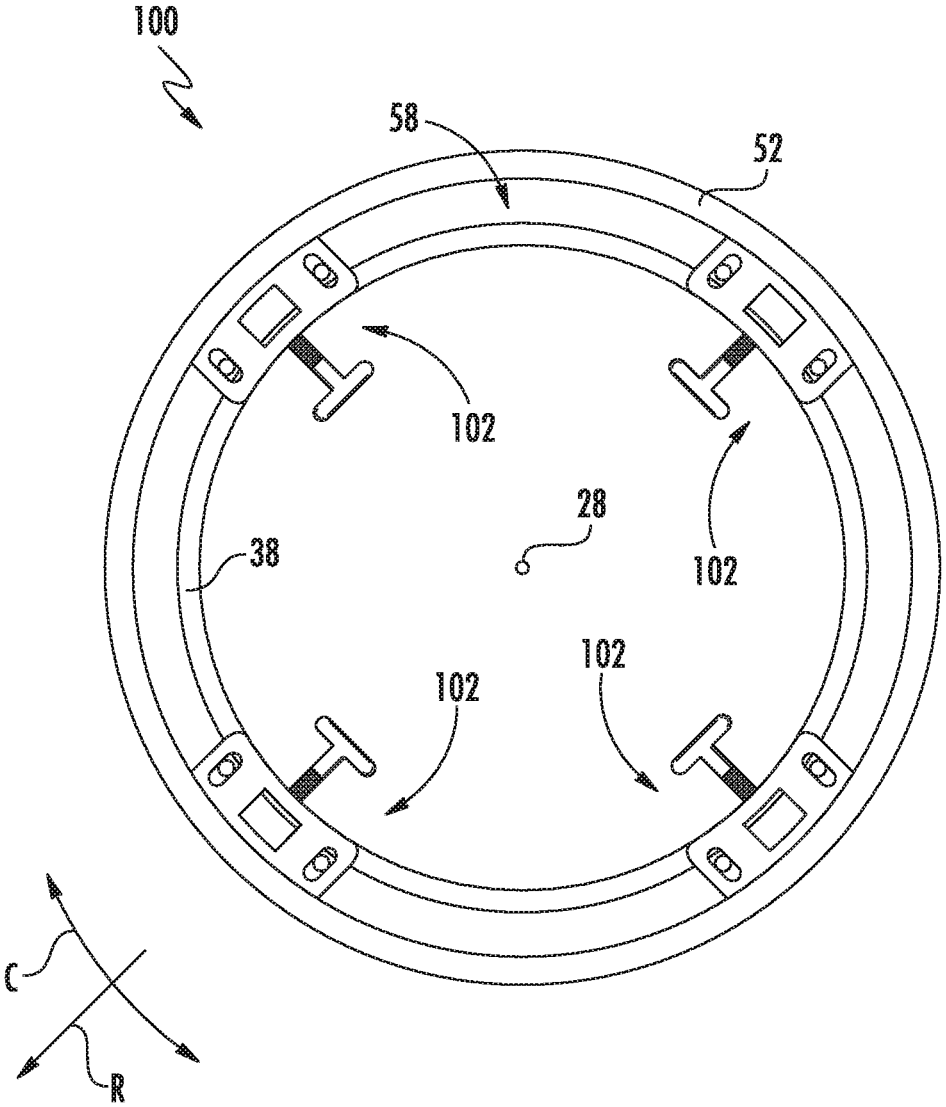
FIG. 3 is a front view of one embodiment of a coupling assembly in accordance with embodiments of the present disclosure.

FIG. 3 illustrates one embodiment of a coupling assembly 100 in accordance with embodiments of the present disclosure. As shown, the coupling assembly 100 includes one or more coupling tools 102 that may couple the combustion liner 38 and the outer sleeve 52. In this respect, the coupling tools 102 may be at least partially positioned within the cooling flow passage 58. In the embodiment shown in FIG. 3, the coupling assembly 100 includes four coupling tools 102 arranged in an axisymmetric manner about the axial centerline 28. In alternate embodiments, however, the coupling assembly 100 may include more or fewer coupling tools 102 and the coupling tools 102 may be arranged in any suitable manner.

Figure 4:
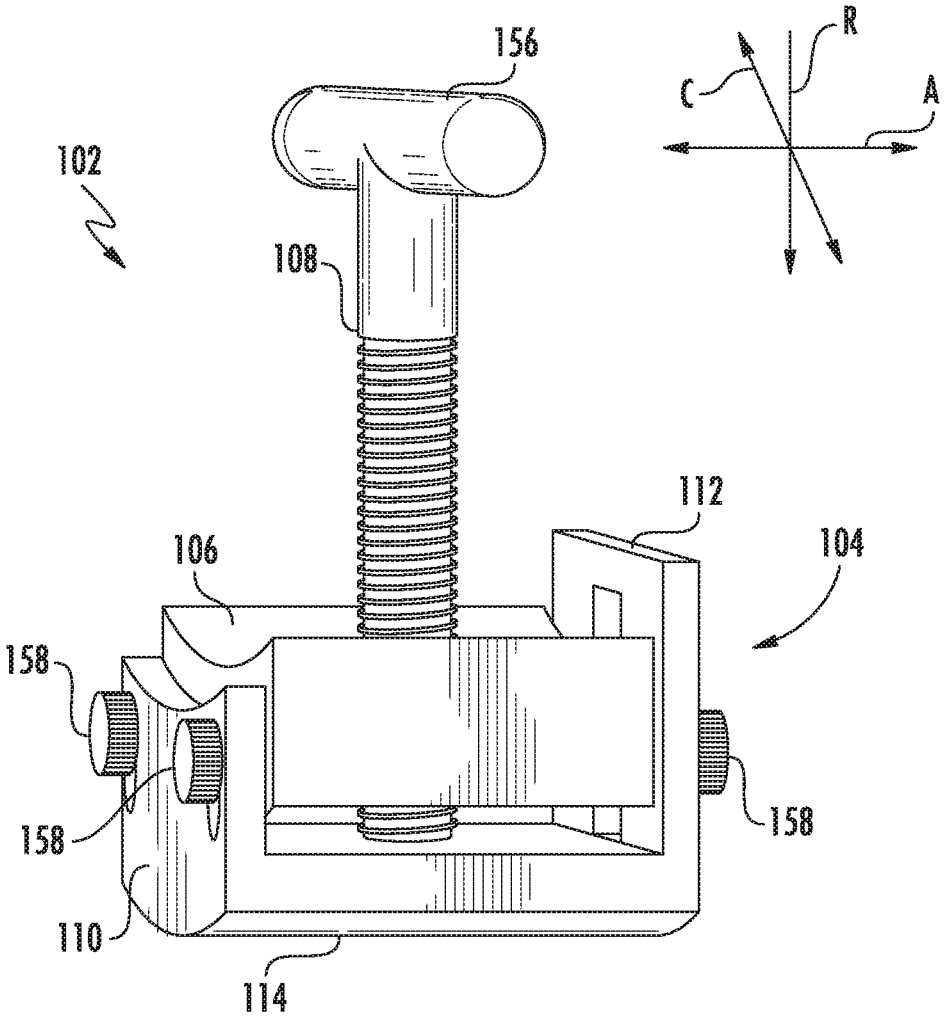
FIG. 4 is a perspective view of one embodiment of a coupling tool in accordance with embodiments of the present disclosure.

FIG. 4 is a perspective view of one of the coupling tools 102. As shown, the coupling tool 102 generally includes a frame 104 and a block 106 movable relative to the frame 104. The coupling tool 102 may also include a threaded member 108 operable to move the block 106 relative to the frame 104.

Figure 5:
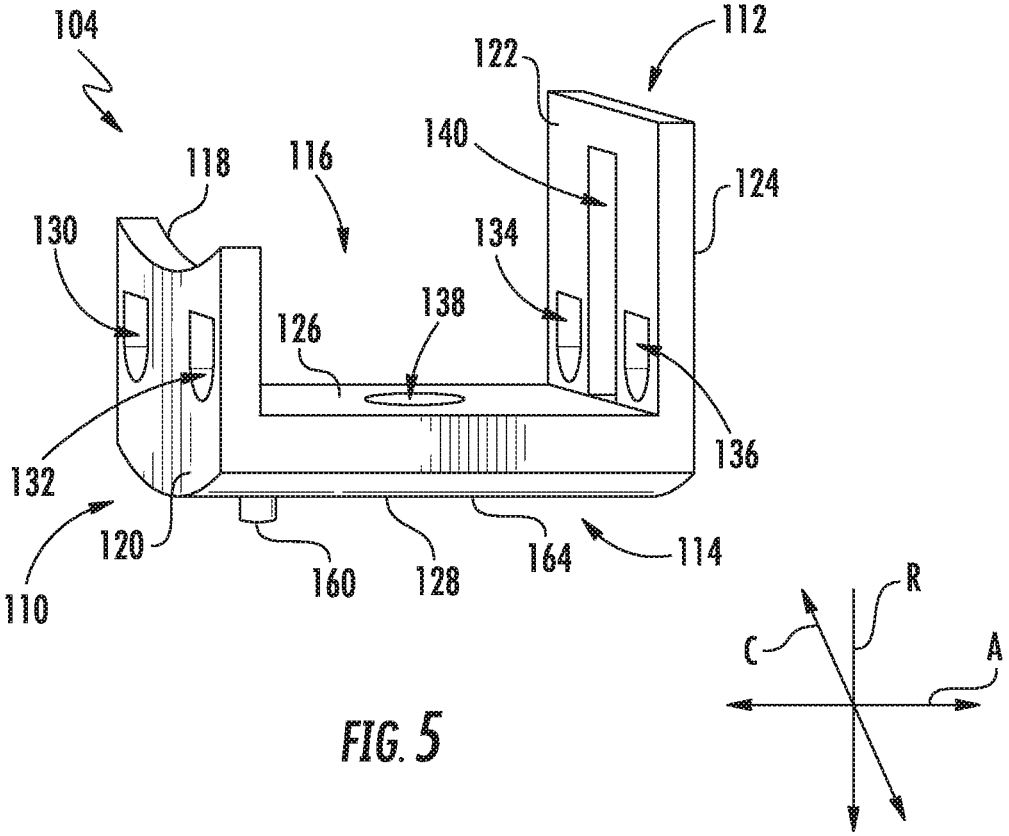
FIG. 5 is a perspective view of a frame of the coupling tool in accordance with embodiments of the present disclosure.

Referring now to FIG. 5, the frame 104 includes a first side wall 110, a second side wall 112, and a base wall 114. In particular, the first and second side walls 110, 112 are axially spaced apart, thereby defining a slot 116 therebetween. The base wall 114 extends from the first side wall 110 to the second side wall 112. In this respect, the frame 104 may have a U-shape in certain embodiments. Nevertheless, the frame 104 may have other suitable configurations in other embodiments.

The first side wall 110, the second side wall 112, and the base wall 114 include various surfaces. More specifically, the first side wall 110 includes an inner surface 118 and an outer surface 120 axially spaced apart from the inner surface 118. Similarly, the second side wall 112 includes an inner surface 122 and an outer surface 124 axially spaced apart from the inner surface 122. As shown in FIG. 5, the inner surfaces and outer surfaces 118, 120, 122, 124 of the first and second side walls 110, 112 are generally parallel. Furthermore, the base wall 114 includes a radially inner surface 126 and a radially outer surface 128 radially spaced apart from the radially inner surface 126. As shown, the inner and outer surfaces 126, 128 of the base wall 114 may be generally perpendicular to the inner surfaces and outer surfaces 118, 120, 122, 124 of the first and second side walls 110, 112. In particular embodiments, the radially outer surface 128 of the base wall 114 may be arcuate to conform to the outer sleeve 52. The inner surface 118 of the first side wall 110, the inner surface 122 of the second side wall 112, and the radially inner surface 126 of the base wall 114 demarcate the boundaries of the slot 116.

The frame 104 may also define various apertures. More specifically, the first side wall 110 may define a first elongated aperture 130 and a second elongated aperture 132 circumferentially spaced apart from the first elongated aperture 130. Similarly, the second side wall 112 may define a first elongated aperture 134 and a second elongated aperture 136 circumferentially spaced apart from the first elongated aperture 134. In certain embodiments, the first elongated apertures 130, 134 are radially and circumferentially aligned. Similarly, the second elongated apertures 132, 136 may also be radially and circumferentially aligned. The elongated apertures 130, 132, 134, 136 are preferably elongated in the radial direction R. As will be discussed in greater detail below, the elongated apertures 130, 132, 134, 136 may receive shafts coupled to the block 106. In this respect, the elongated nature of the elongated apertures 130, 132, 134, 136 permits the block 106 to move in the radial direction R. Furthermore, the base wall 114 may optionally define an aperture 138 that receives the threaded member 108. The second side wall 112 may optionally define a central aperture 140 positioned circumferentially between the first and second elongated apertures 134, 136. In alternate embodiments, the side walls 110, 112 may each define one, three, or more elongated apertures.

Figure 6:
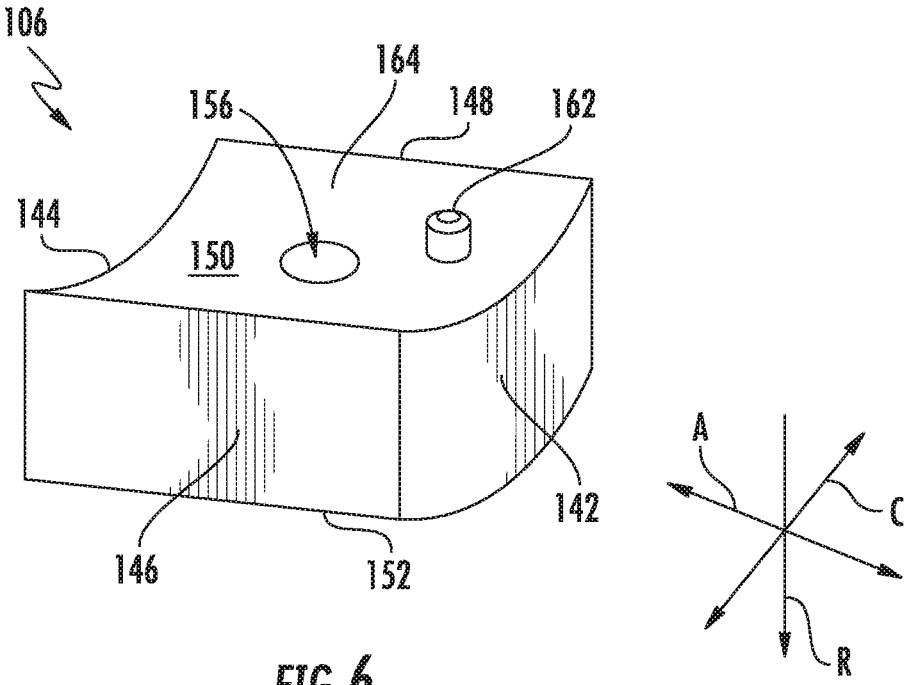
FIG. 6 is a perspective view of a block of the coupling tool in accordance with embodiments of the present disclosure.

FIG. 6 is a perspective view of the block 106. As shown, the block 106 may include a first axial surface 142 and a second axial surface 144 axially spaced apart from the first axial surface 142. Similarly, the block 106 may include a first circumferential surface 146 and a second circumferential surface 148 circumferentially spaced apart from the first circumferential surface 146. The block 106 may also include a radially inner surface 150 and a radially outer surface 152 radially spaced apart from the radially inner surface 150. In particular embodiments, the radially inner and outer surfaces 150, 152 may be arcuate to conform to the combustion liner 38. Furthermore, the block 106 may define a threaded aperture 154 extending therethrough from radially inner surface 150 to the radially outer surface 152.

As mentioned above, the coupling tool 102 includes the threaded member 108. More specifically, the threaded member 108 may threadingly engage the block 106 via the threaded aperture 154. In this respect, the threaded member 108 may be operable to move the block 106 toward and away from the base wall 114 of the frame 104. In the embodiment shown in FIG. 4, the threaded member 108 is a jack bolt. In alternate embodiments, the threaded member 108 may be any suitable bolt, screw, or other device that threadingly engages the block 106. The threaded member 108 may optionally include a handle 156 to facilitate rotation of the threaded member 108.

As shown in FIG. 4, the block 106 is positioned within the slot 116 defined by frame 104. More specifically, the block 106 is positioned axially between the inner surfaces 118, 122 of the first and second side walls 110, 112. In this respect, the first axial surface 142 of the block 106 is position adjacent to the inner surface 118 of the first side wall 110. Similarly, the second axial surface 144 of the block 106 is position adjacent to the inner surface 122 of the second side wall 112.

As mentioned above, the block 106 is movable relative to the frame 104. In particular, one or more shafts 158 may project outwardly from each of the first and second axial surfaces 142, 144 of the block 106. Each shaft 158 may extend through one of the elongated apertures 130, 132, 134, 136. The elongated apertures 130, 132, 134, 136 permit the shafts 158 to move radially inward and outward therein. In this respect, block 106 may move radially within the slot 116, i.e., toward and away from the base wall 114.

Figure 7:
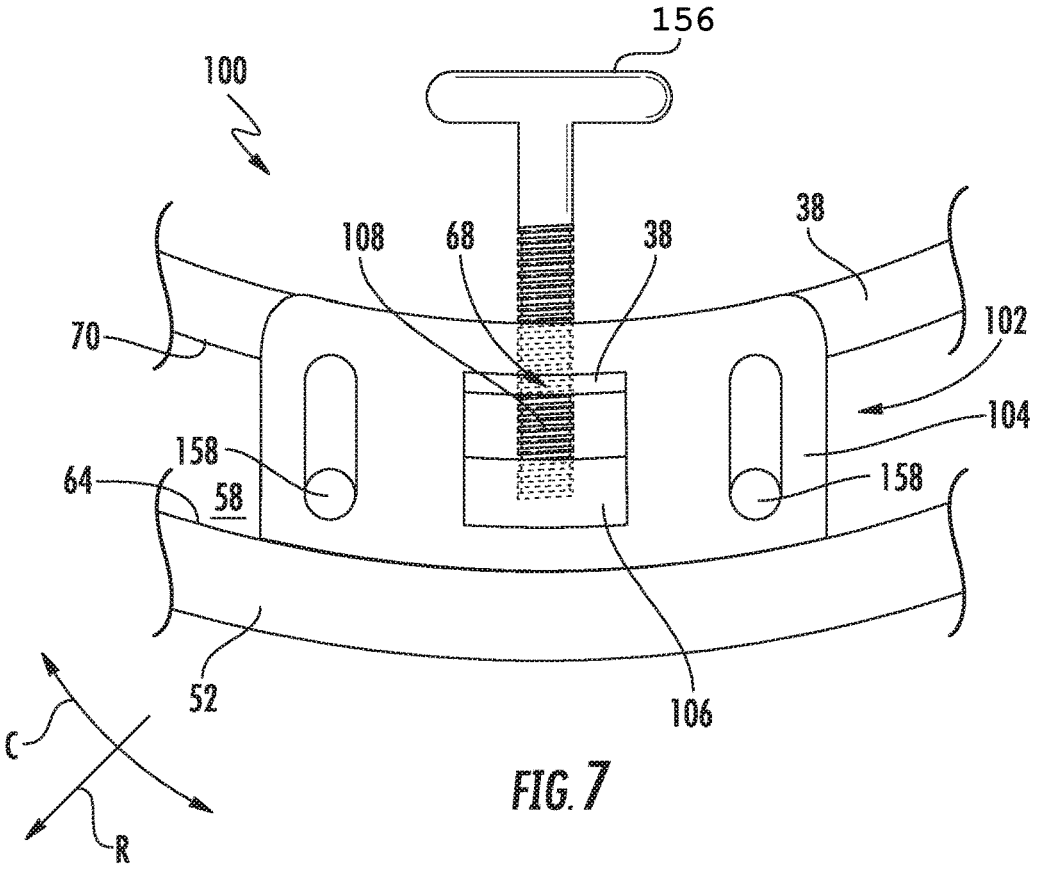
FIG. 7 is a front view of the coupling assembly, illustrating the block in a decoupled position in accordance with embodiments of the present disclosure.

FIG. 7 illustrates the coupling assembly 100 when the block 106 is in a decoupled position. More specifically, the coupling tool 102 (i.e., the frame 104 and the block 106) is at least partially positioned within the cooling flow passage 58 between the combustion liner 38 and the outer sleeve 52. The base wall 114 of the frame 104 is in contact with a radially inner surface 64 of the outer sleeve 52. The base wall 114 may include a projection 160 (FIG. 5) that engages a dimple or an aperture (e.g., an aperture 66 shown in FIG. 9) defined by the outer sleeve 52 to facilitate positioning of the coupling tool 102 within the cooling flow passage 58. The threaded member 108 may extend through an aperture 68 defined by the combustion liner 38 to threadingly engage the block 106. When in the decoupled position, the block 106 is spaced apart from the combustion liner 38. As such, the combustion liner 38 may move relative to the outer sleeve 52.

Figure 8:
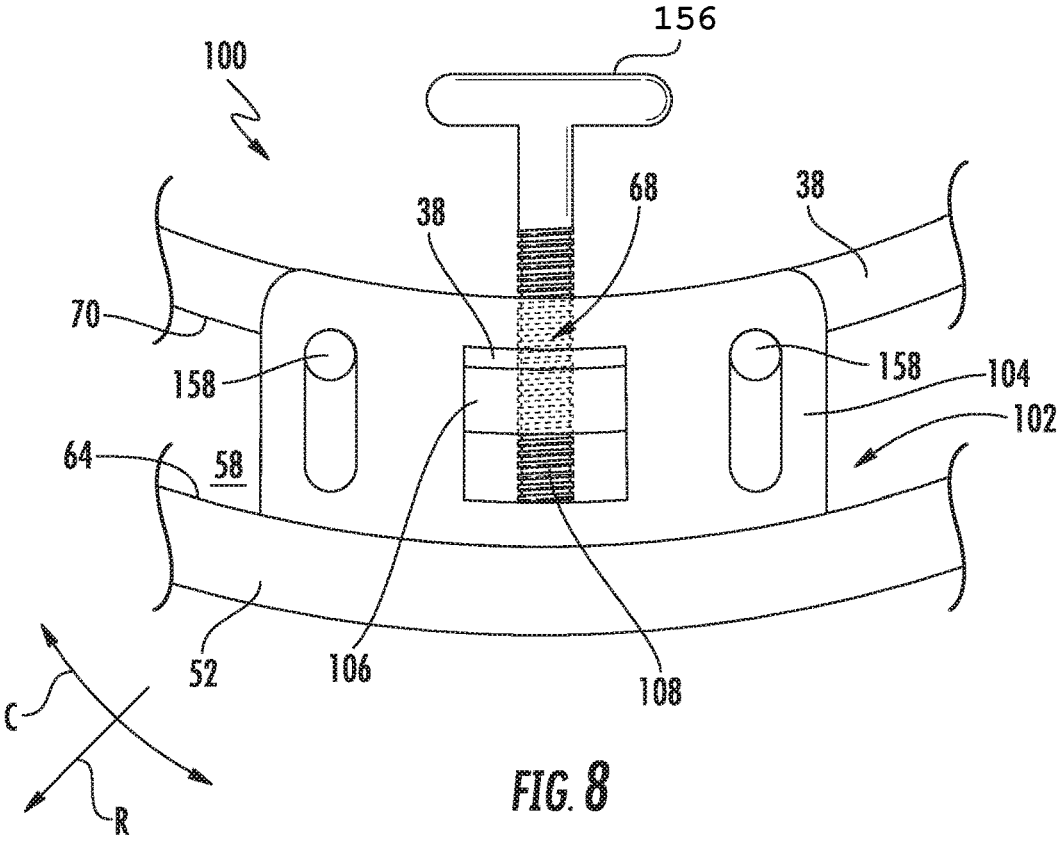
FIG. 8 is a front view of the coupling assembly, illustrating the block in a coupled position in accordance with embodiments of the present disclosure.

FIG. 8 illustrates the coupling assembly 100 when the block 106 is in the coupled position. More specifically, the radially inner surface 150 of the block 106 is in contact with a radially outer surface 70 of the combustion sleeve 38. When in the coupled position, the block 106 exerts a radially inward force on the combustion liner 38 and the base wall 114 of the frame 104 exerts a radially outward force on the outer sleeve 52. These opposing forces couple the combustion liner 38 and the outer sleeve 52, thereby preventing relative movement therebetween. The radially inner wall 150 of the block 106 may include a projection 162 (FIG. 6) that engages a dimple or an aperture (e.g., an aperture 72 shown in FIG. 9) defined by the combustion liner 38. The base wall 114 of the frame 104 and the radially inner surface 150 of the block 106 may include a friction material 164 (FIGS. 5 and 6) to reduce the opposing forces necessary to couple the combustion liner 38 and the outer sleeve 52.

The threaded member 108 may be operable to move the block 106 relative to the frame 106, such as between the decoupled and coupled positions. For example, rotating the threaded member 108 in a first direction (e.g., clockwise) moves the block 106 radially inward and away from the base wall 114, such as to a coupled position. Similarly, rotating the threaded member 108 in a second direction opposite of the first direction (e.g., counterclockwise) moves the block 106 radially outward and toward from the base wall 114, such as to a decoupled position. As such, moving the block 106 away from the base wall 114 causes the block 106 to exert a radially inward force on the combustion liner 38 and the base wall 114 to exert a radially outward force on the outer sleeve 52 by the base wall 114. Conversely, moving the block 106 toward the base wall 114 releases the radially inward force exerted on the combustion liner 38 by the block 106 and the radially outward force exerted on the outer sleeve 52 by the base wall 114.

Figure 9:
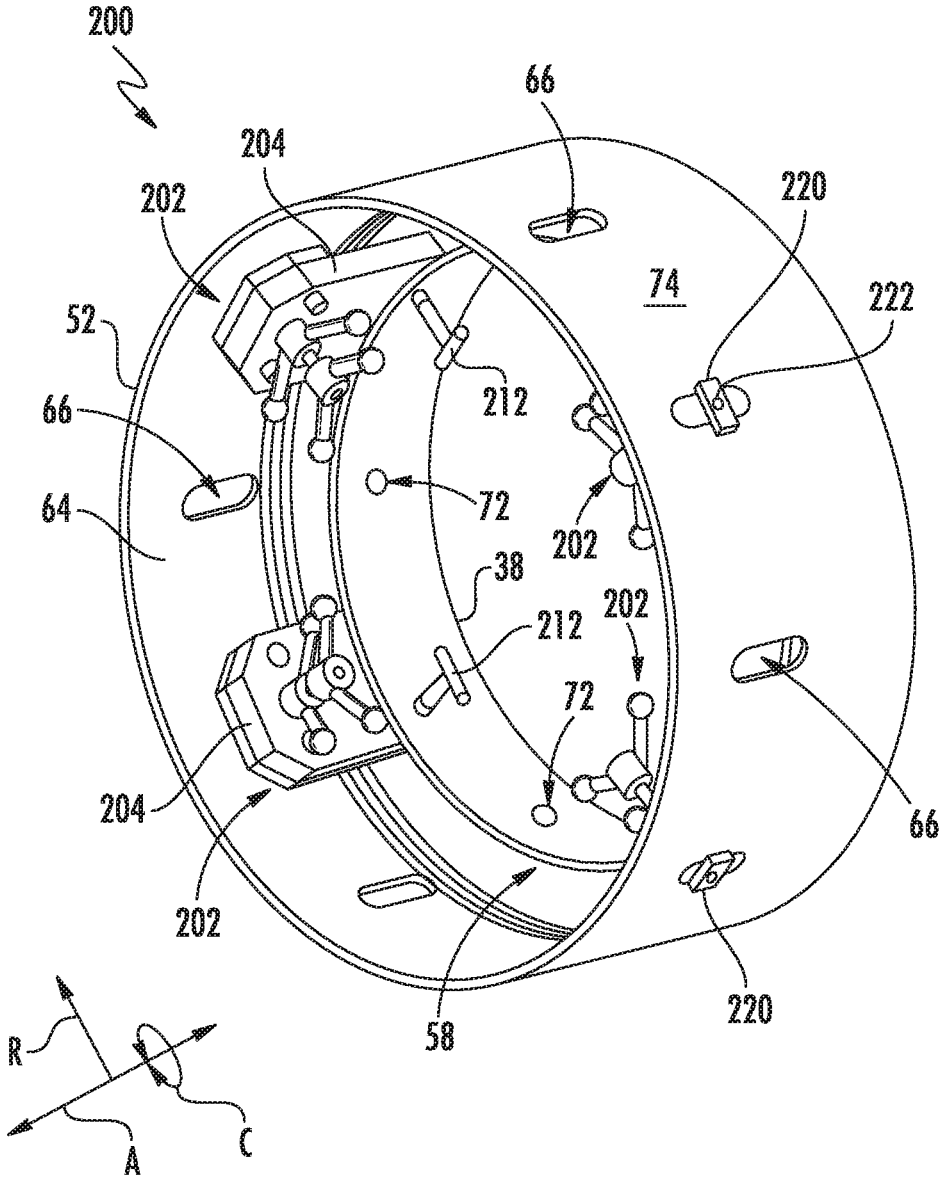
FIG. 9 is a front view of an alternate embodiment of a coupling assembly in accordance with embodiments of the present disclosure.

FIG. 9 illustrates an alternate embodiment of a coupling assembly 200 in accordance with embodiments of the present disclosure. As shown, the coupling assembly 200 includes one or more coupling tools 202 that may couple the combustion liner 38 and the outer sleeve 52. In this respect, the coupling tools 202 may be at least partially positioned within the cooling flow passage 58. In the embodiment shown in FIG. 9, the coupling assembly 200 includes four coupling tools 202 arranged in an axisymmetric manner. In alternate embodiments, however, the coupling assembly 200 may include more or fewer coupling tools 202 and the coupling tools 202 may be arranged in any suitable manner.

Figure 10:
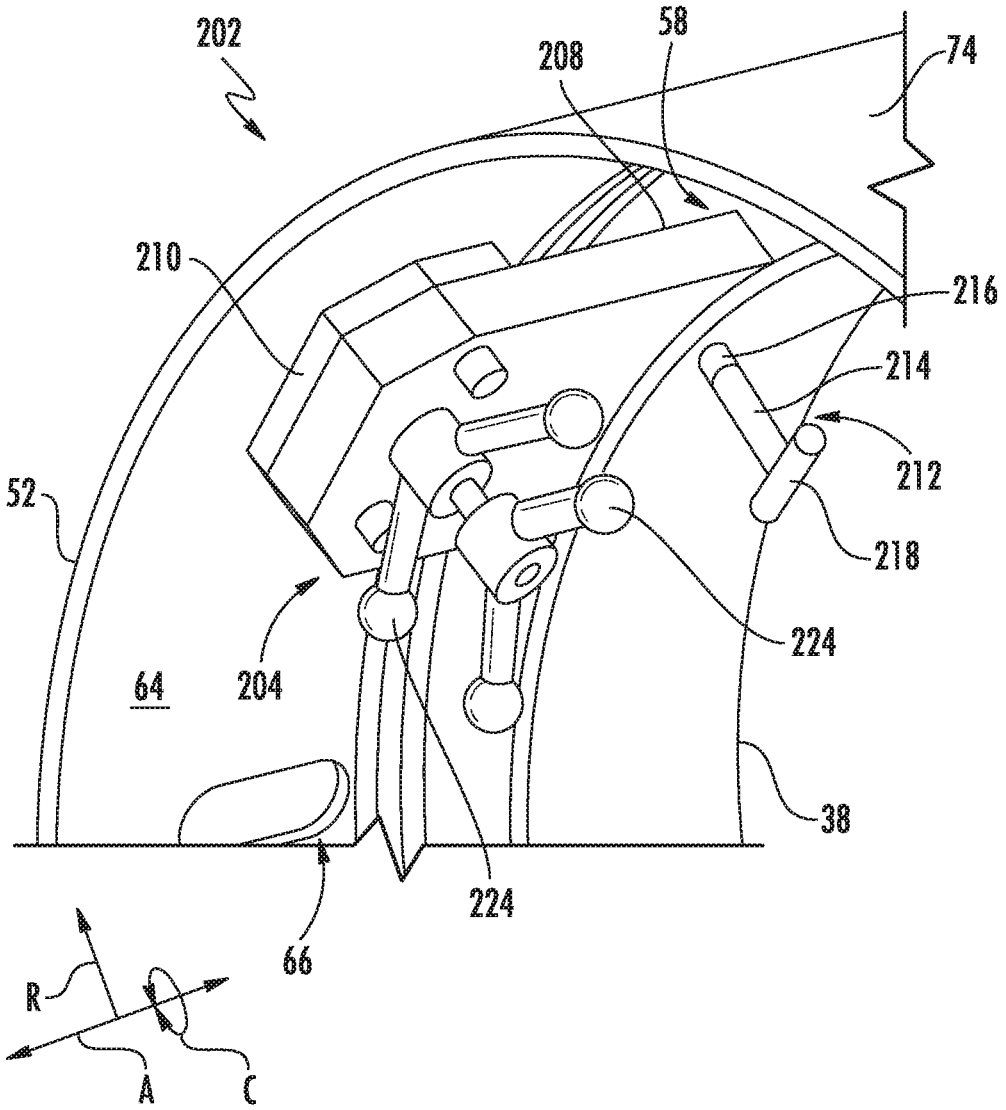
FIG. 10 is a perspective view of an alternate embodiment of a coupling tool in accordance with embodiments of the present disclosure.

Referring now to FIGS. 9 and 10, each coupling tool 202 may include a body 204 positioned within the cooling flow passage 58. More specifically, the body 204 includes a radially inner surface 206 and a radially outer surface 208 spaced apart from the radially inner surface 206. In the embodiment shown in FIGS. 9 and 10, a projection or pad 210 extends radially outward from the radially outer surface 208 of the body 204. As shown, the radially inner surface 206 of the body 204 is in contact with the radially outer surface 70 of the combustion liner 38. Similarly, the projection 210 is in contact with the radially inner surface 64 of the outer liner 52. In alternate embodiments, the body 204 may not include the projection 210. In such embodiments, the radially outer surface 208 of the body 204 may be in contact with the radially inner surface 64 of the outer liner 52.

Each coupling tool 202 also includes a pin 212 that couples the body 204 to the combustion liner 38. In particular, the pin 212 includes a shaft portion 214 that extends through one of the apertures 72 defined by the combustion liner 38 to engage the body 204. The pin 212 may include an enlarged portion 216 that is wider than the apertures 72. Some embodiments of the pin 212 may include a handle 218 to facilitate manipulation of the pin 212.

Each coupling tool 202 further includes a clamp member 220. As shown in FIG. 9, the clamp member 220 is positioned radially outward from the outer sleeve 52. In particular, the clamp member 220 may be in contact with a radially outer surface 74 of the outer sleeve 52. In the embodiment shown in FIG. 9, the clamp member 220 is a block that exerts radially inward force on the outer sleeve 52. In alternate embodiments, however, the clamp member 220 may be any suitable component that may exert radially inward force on the outer sleeve 52.

A threaded member 222 couples the body 204 and the clamp member 220. More specifically, the threaded member 222 extends one of the apertures 66 defined by the outer sleeve 52. The threaded member 222 may be operable, via one or more handles 224 shown in FIG. 10, to move the clamp member 220 toward and away from the body 204 (i.e., radially inward and radially outward). Moving the clamp member 220 toward from the body 204 causes the body 204 to exert a radially outward force on the outer sleeve 52 and the clamp member 220 to exert a radially inward force on the outer sleeve 52 to couple the outer sleeve 52 and the body 204. When the combustion liner 38 and the outer sleeve 52 are coupled to the body 204, the combustion liner 38 and the outer sleeve 52 are coupled. That is, the combustion liner 38 is unable to move relative to the outer sleeve 52. Conversely, moving the clamp member 220 away from the body 204 releases the radially outward force exerted on the outer sleeve 52 by the body 204 and the radially inward force exerted on the outer sleeve 52 by the body 204 to decouple the outer sleeve 52 and the body 204. When this occurs, the combustion liner 38 may move relative to the outer sleeve 52.

Although described above as coupling the combustion liner 38 and the outer sleeve 52, the coupling tools 102, 202 may be used to couple any liner and sleeve in the gas turbine engine 10. In fact, the coupling tools 102, 202 may be used to couple any pair of adjacent components in any type of turbomachine.

As discussed in greater detail, the coupling assemblies 100, 200 and, more specifically, the coupling tools 102, 202 selectively couple the combustion liner 38 and the outer sleeve 52 together. In this respect, the coupling tools 102, 202 prevent relative movement the combustion liner 38 and the outer sleeve 52, e.g., during removal from the gas turbine engine 10. As such, the coupling tools 102, 202 protect the coatings applied the combustion liner 38 and the outer sleeve 52. Accordingly, the coupling assemblies 100, 200 reduce the likelihood of expensive and time-consuming repairs to the combustion liner 38 and the outer sleeve 52 necessitated by removal from the gas turbine engine 10.

This written description uses examples to disclose the technology, including the best mode, and also to enable any person skilled in the art to practice the technology, including making and using any devices or systems and performing any incorporated methods. The patentable scope of the technology is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A coupling assembly for a turbomachine, the turbomachine defining an axial centerline and a radial direction extending perpendicularly to the axial centerline, the coupling assembly comprising:

a liner;

a sleeve at least partially positioned circumferentially around the liner;

a frame positioned between the liner and the sleeve, the frame including a first side wall, a second side wall, and a base wall extending from the first side wall to the second side wall; and a block positioned between the liner and the sleeve, the block being movable in the radial direction relative to the frame to permit the block to move toward and away from the base wall in the radial direction;

wherein moving the block away from the base wall in the radial direction causes the block to contact the liner and to exert an inward force on the liner and the base wall to contact the sleeve and to exert an outward force on the sleeve.

2. The coupling assembly of claim 1, further comprising:

a threaded member that threadingly engages the block via a threaded aperture defined by the block to move the block toward or away from the base wall.

3. The coupling assembly of claim 2, wherein the threaded member is a jack bolt.

4. The coupling assembly of claim 1, wherein the base wall and the block comprise arcuate surfaces.

5. The coupling assembly of claim 1, wherein the base wall and the block each comprise a friction material.

6. The coupling assembly of claim 1, wherein the block comprises a projection received by an aperture or dimple defined by the liner.

7. The coupling assembly of claim 1, wherein the base wall comprises a projection received by an aperture or dimple defined by the sleeve.

8. The coupling assembly of claim 1, wherein the first side wall and the second side wall each define elongated slots extending therethrough for receiving shafts extending outward from the block.

9. The coupling assembly of claim 1, wherein the frame has a U-shape.

10. The coupling assembly of claim 1, wherein moving the block toward the base wall releases the inward force exerted on the liner by the block and the outward force exerted on the sleeve by the base wall.

11. A turbomachine defining an axial centerline and a radial direction extending perpendicularly to the axial centerline, the turbomachine comprising:

a combustion liner having an outer surface;

an outer sleeve at least partially positioned circumferentially around the combustion liner; and a plurality of coupling tools for coupling the combustion liner and the outer sleeve, each coupling tool comprising:

a frame positioned between the combustion liner and the outer sleeve, the frame including a first side wall, a second side wall, and a base wall extending between the first side wall and the second side wall, wherein the second side wall extends radially inward from the outer surface of the combustion liner; and a block positioned between the combustion liner and the outer sleeve, the block being movable in the radial direction relative to the frame to permit the block to move toward and away from the base wall in the radial direction;

wherein moving the block away from the base wall in the radial direction causes the block to contact the combustion liner and to exert an inward force on the combustion liner and the base wall to contact the outer sleeve and to exert an outward force on the outer sleeve.

12. The turbomachine of claim 11, wherein the plurality of coupling tools are axisymmetrically arranged about a centerline of the combustion liner and the outer sleeve.

13. The turbomachine of claim 11, further comprising:

a threaded member that threadingly engages the block via a threaded aperture defined by the block to move the block toward or away from the base wall.

14. The turbomachine of claim 11, wherein the base wall and the block comprise arcuate surfaces.

15. The turbomachine of claim 11, wherein the base wall and the block each comprise a friction material.

16. The turbomachine of claim 11, wherein the block comprises a projection received by an aperture or dimple defined by the combustion liner.

17. The turbomachine of claim 11, wherein the base wall comprises a projection received by an aperture or dimple defined by the outer sleeve.

18. The turbomachine of claim 11, wherein the first side wall and the second side wall each define elongated slots extending therethrough for receiving shafts extending outward from the block.

19. The turbomachine of claim 11, wherein moving the block toward the base wall releases the inward force exerted on the combustion liner by the block and the outward force exerted on the outer sleeve by the base wall.

* * * * *